United States Patent [19]

Polack

[11] 4,159,602

[45] Jul. 3, 1979

[54] THREE-DIMENSIONAL CONSTRUCTION ELEMENT COMPRISING A BODY OF GENERALLY POLYHEDRAL FORM

[75] Inventor: Andre M. Polack, Brussels, Belgium

[73] Assignee: Matrapa S.A., Geneva, Switzerland

[21] Appl. No.: 785,571

[22] Filed: Apr. 7, 1977

[30] Foreign Application Priority Data

Apr. 9, 1976 [CH] Switzerland ..... 04577/76

[51] Int. Cl.[2] ..... E04B 1/348

[52] U.S. Cl. ..... 52/79.9; 52/79.7; 52/79.14; 52/143; 52/227; 52/589; 52/745

[58] Field of Search ..... 52/79.9, 79.2, 602, 52/79.1, 236.3, 236.4, 228, 79.14, 79.11, 438, 429, 437, 589, 227, 79.7, 143, 745

[56] References Cited

U.S. PATENT DOCUMENTS

| | | | |
|---|---|---|---|
| 2,593,465 | 4/1952 | LeTourneau | 52/143 X |
| 2,904,849 | 9/1959 | Bergstrom | 52/79.9 X |
| 3,247,630 | 4/1966 | Kesting | 52/143 |
| 3,292,327 | 12/1966 | Van Der Lely | 52/79.13 |
| 3,468,081 | 9/1969 | Saarinen | 52/79.13 |
| 3,514,910 | 6/1970 | Comm | 52/79.14 |
| 3,609,929 | 10/1971 | Brown et al. | 52/79.7 |
| 3,679,177 | 7/1972 | Scholz | 52/79.1 |
| 3,762,115 | 10/1973 | McCaul et al. | 52/236.9 |
| 3,778,528 | 12/1973 | Heifetz et al. | 52/79.1 X |
| 3,905,167 | 9/1975 | Watkins et al. | 52/79.9 |
| 3,913,286 | 10/1975 | Boutacoff | 52/79.1 X |
| 3,982,366 | 9/1976 | Haapala | 52/79.14 |
| 4,016,686 | 4/1977 | Hartger et al. | 52/79.9 X |

FOREIGN PATENT DOCUMENTS

| | | | |
|---|---|---|---|
| 106244 | 1/1967 | Denmark | 52/79.9 |
| 823209 | 12/1951 | Fed. Rep. of Germany | 52/79.9 |
| 2200052 | 7/1973 | Fed. Rep. of Germany | 52/79.14 |
| 1376442 | 9/1964 | France | 52/79.1 |

*Primary Examiner*—Alfred C. Perham
*Attorney, Agent, or Firm*—Miller & Prestia

[57] ABSTRACT

A three-dimensional construction element comprising a body of generally polyhedral form with an aperture therethrough. Said element comprises at least one peripheral rib forming a statically indeterminate frame the neutral axis of which is located in a plane parallel to the planes defining the ends of the element having the aperture therethrough, and in that the grooves located beside the rib form, separately or together, a geometric figure which is complementary to the figure formed by the rib. (FIG. 1).

27 Claims, 21 Drawing Figures

FIG. 9
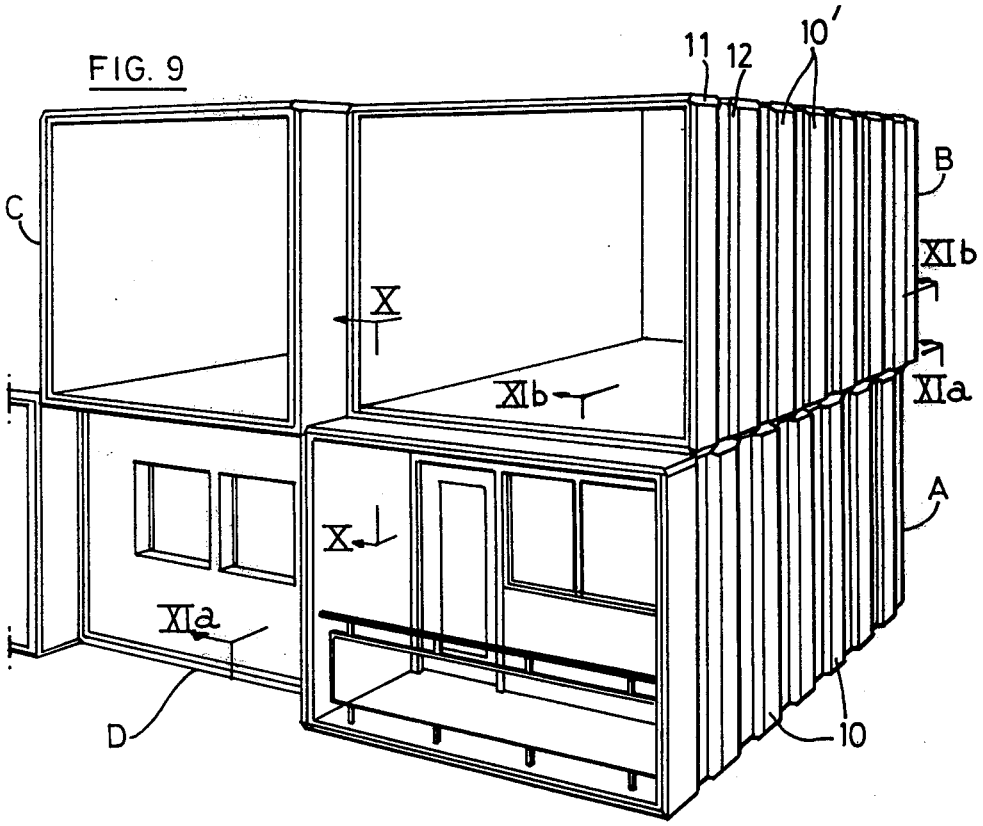
FIG. 10
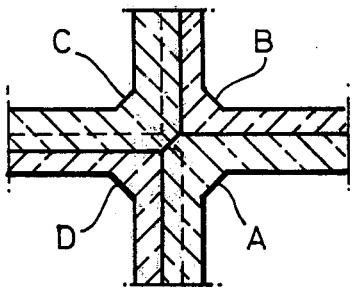
FIG. 11b
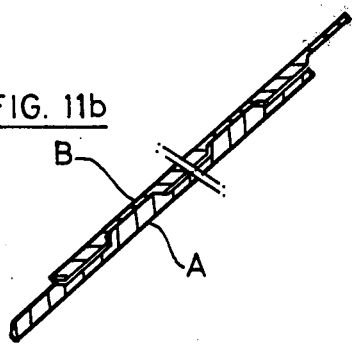
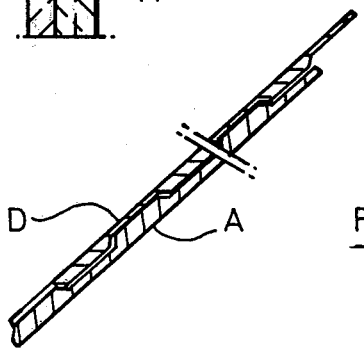
FIG. 11a

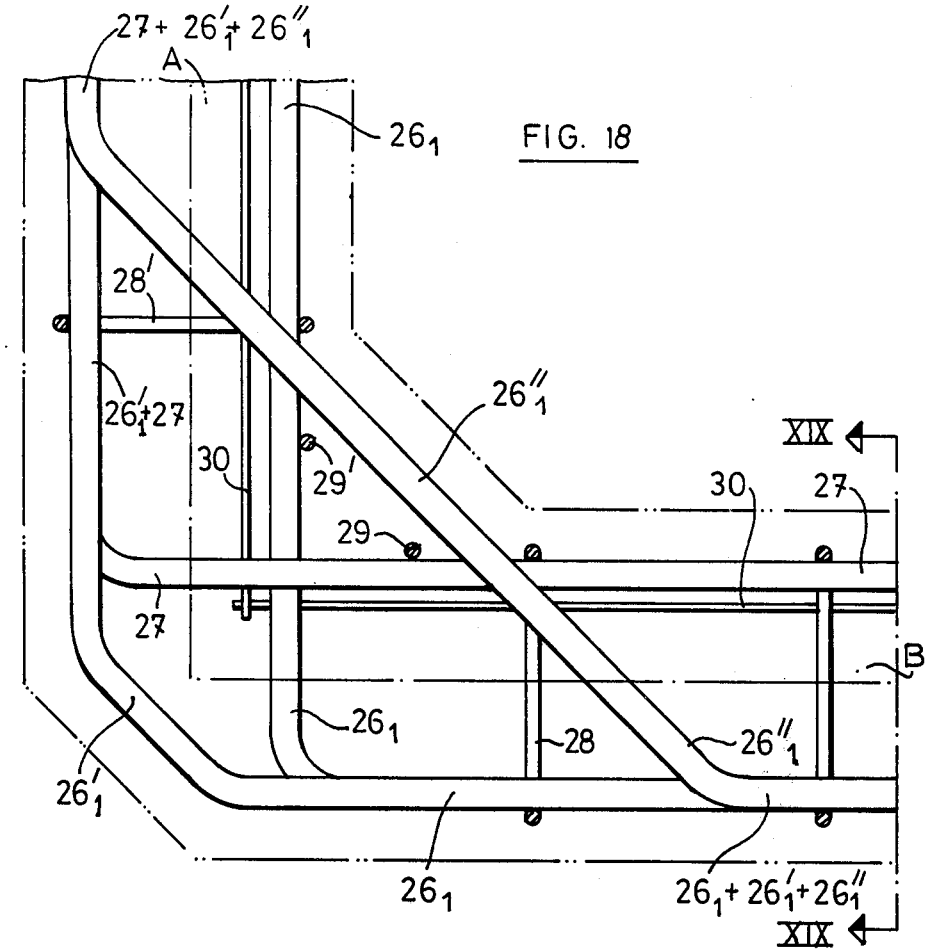
FIG. 18
FIG. 19
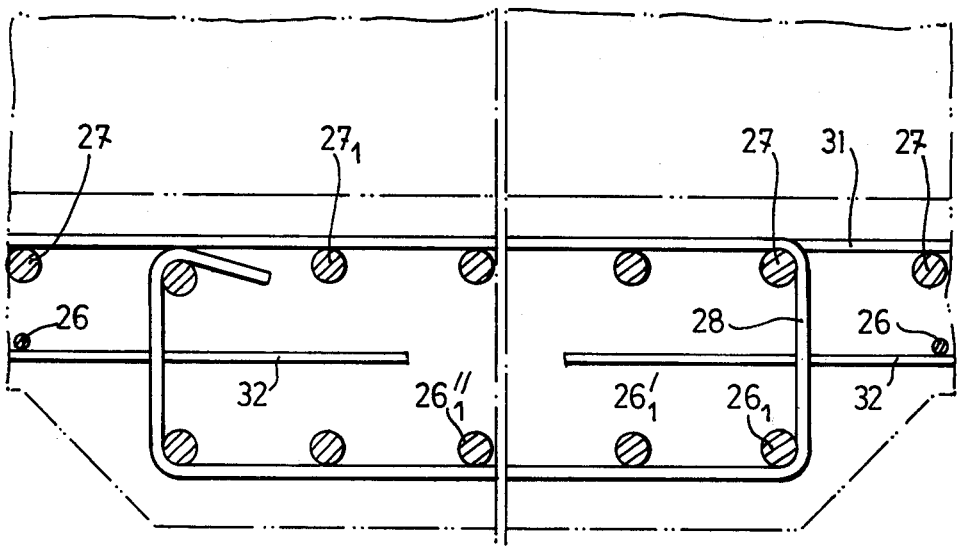

THREE-DIMENSIONAL CONSTRUCTION ELEMENT COMPRISING A BODY OF GENERALLY POLYHEDRAL FORM

The present invention relates to a 3-dimensional construction element comprising a body of generally polyhedral form with an aperture therethrough.

The invention also comprises a process for producing this element and its use for forming dwelling units in the construction of apartment buildings, hospitals, hotels, etc.

Elements produced by assembling slabs are known and may be transported in their assembled state without departing from the regulations, if they are small enough.

Thus, the idea of constructing a large continuous room by assembling a number of successive elements was conceived.

However, whatever solution is adopted, the elements manufactured cannot be very large; on the one hand owing to their lack of rigidity in the position of use and on the other hand owing to transportation problems, since in fact these elements do not have the necessary to rigidity to enable them to be turned over onto their smaller side in order to correspond to the traditional road gauge.

It is obvious that the handling of any elements consisting of assembled slabs will necessarily lead to their becoming dislocated to a greater or lesser extent before arriving on site.

This would not happen if, as proposed by the invention, the elements or cells formed a rigid block consisting of at least one closed frame of greater or lesser thickness or depth, suitably reinforced with brackets or some other means in the corners in order to ensure extra rigidity, or formed by a very dense assembly of frames, such a frames hardly deforms at all owing to the rigidity of the material itself which is not broken at any point.

Another object of the invention consists in providing superimposable structures consisting of complementary and thus closely overlapping elements, resulting in a mortar-less construction of extreme solidity which is therefore resistant to ordinary forces whilst providing a hitherto to unknown behaviour and resistance of construction when subjected to seismic forces.

Therefore, the invention intends to remedy the known dissadvantages by proposing a three dimensional element, characterised in that it comprises at least one peripheral rib forms a statically indeterminate closed frame the central neutral axis of which is located in a plane parallel to the planes defining the apertures at the end of the element the sides of said rib and the corners of said element are bevelled, and in that the grooves located beside the rib form, separately or together, a geometric figure complementary to the figure formed by the rib thereby providing for the engagement of another complementary rib therein. Consequently, the statically indeterminate frame will be termed an elemental frame.

The external ribs carried by the element will have the combined effect of contributing to the strength of the statically indeterminate structure and interlocking between the similar ribs of an adjacent element.

By using the construction element according to the invention, a number of elements are vertically or horizontally juxtaposed and superimposed in such a way that their ribs mutually interlock and retain the elements between them without any need for binding material.

The accompanying drawing shows, by way of example, an embodiment of the assembly of construction elements according to the invention, together with variants, and illustrate methods of carrying out the manufacturing process of this element and its use in the construction of an apartment building.

FIG. 9 is a perspective view of several assembled elements;

FIG. 10 is a section on the line X—X in FIG. 9;

Figure 4:
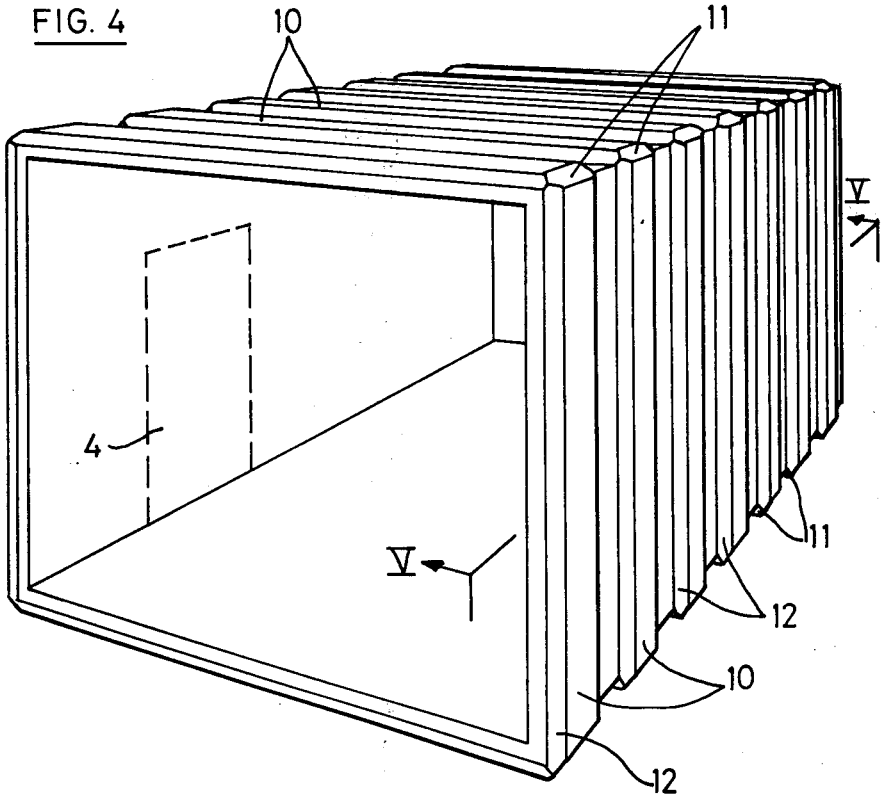
FIG. 4 is a perspective view of a three-dimensional construction element having a plurality of ribs as shown in FIG. 1.
Figure 13:
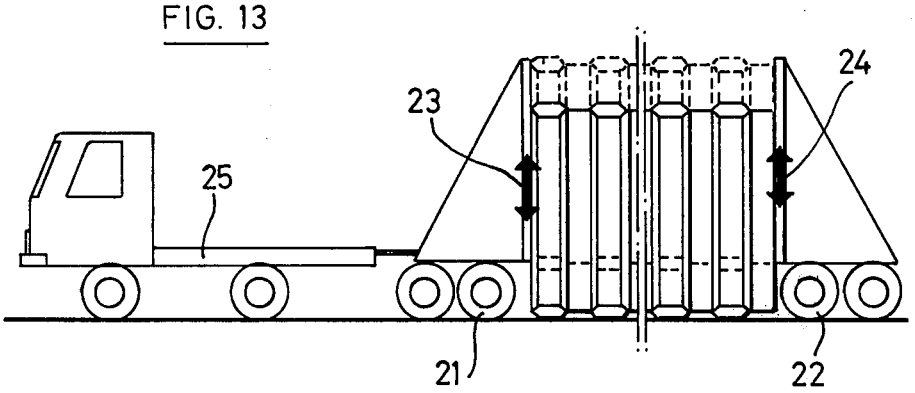
Figure 14:
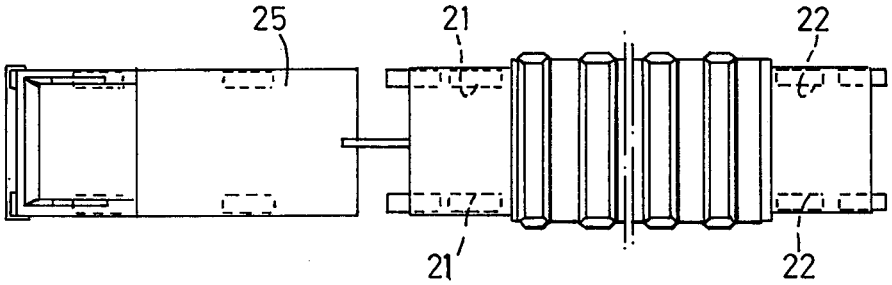
Figure 15:
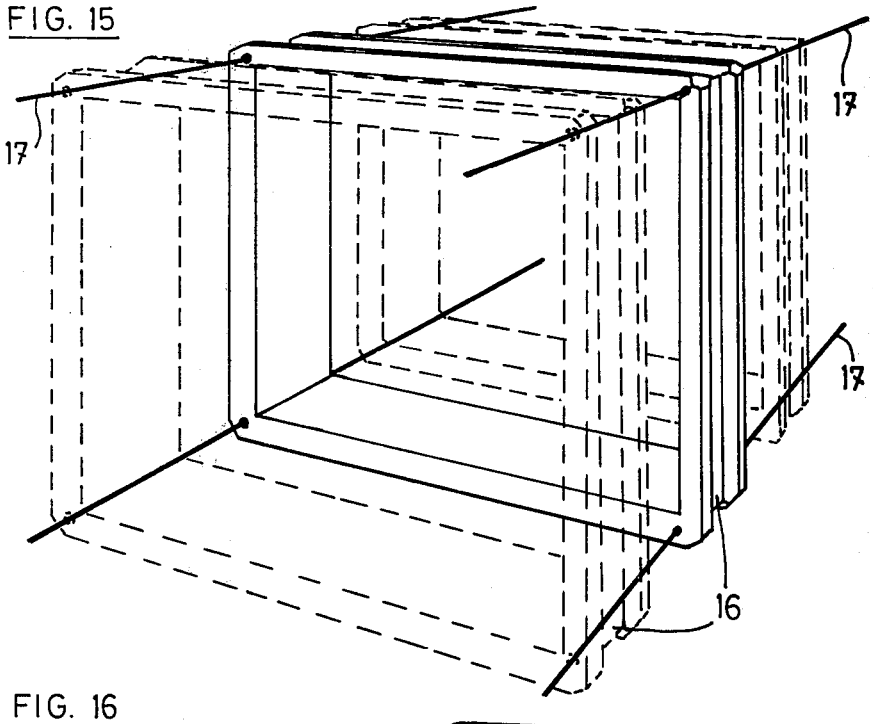
Figure 16:
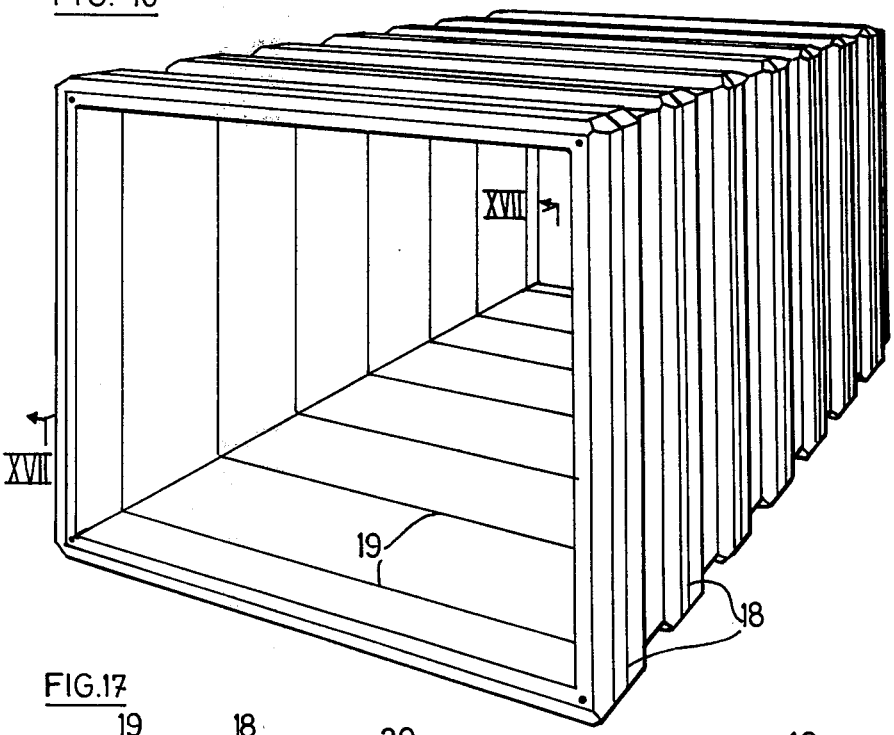
Figure 17:
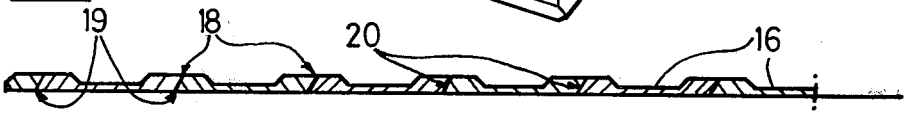

FIG. 11*a* and 11*b* are sections on the lines XI*a*—XI*a* and XI*b*—XI*b*, respectively, in FIG. 9;

FIGS. 12(*a*) and 12(*b*) are end views of an element showing it being tipped over so as to use the smallest side as a transporting surface;

FIG. 13 is a lateral view of a construction element together with the road transport means;

FIG. 14 is a plan view of FIG. 13;

FIG. 15 is a perspective view illustrating one phase of the manufacturing process of a construction element similar to that in FIG. 4;

FIG. 16 is a perspective view of this finished element;

FIG. 17 is a section on line XVII—XVII in FIG. 16;

FIG. 18 is a vertical section through a rib in a corner of the frame;

FIG. 19 is a cross section along the line XIX—XIX in FIG. 18.

Figure 1:
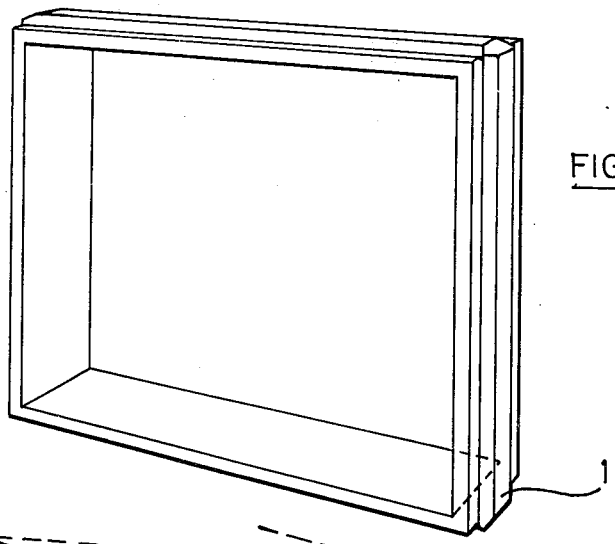
FIG. 1 is a perspective view of a three-dimensional construction element of the present invention, shown as having one peripheral rib.

The elemental frame provided with a rib at 1 as shown in FIG. 1 is made extra-rigid by the presence of reinforcements in the lateral walls and in the corners of the frame, the arrangement of these reinforcements being shown in FIGS. 18 and 19 which will be described below.

Figure 2:
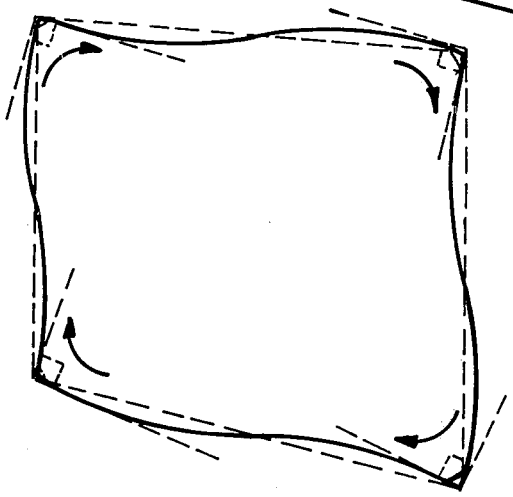
FIG. 2 is a diagram of the deformation of the elemental frame in FIG. 1.

FIG. 2 shows the deformation of this frame under the effect of external forces. It will be seen that the angles of the frame remain practically undeformed.

Figure 3:
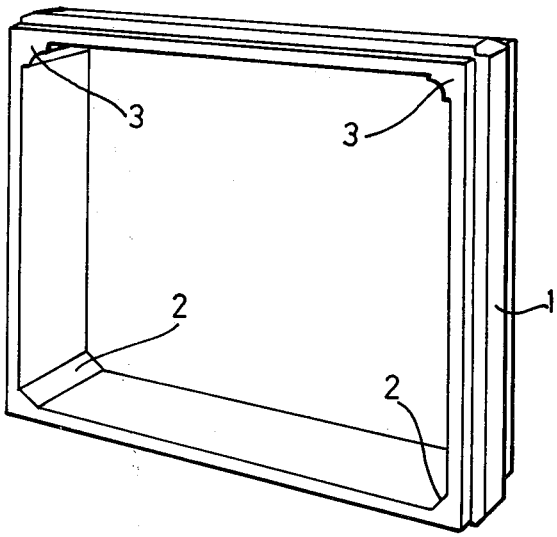
FIG. 3 is a view of a variant, similar to FIG. 1.

To increase the rigidity of theribbed elemental frame 1, the internal angles of this frame may optionally be inclined at 2, or moulded at 3, equally for decorative purposes, as shown in FIG. 3.

The three-dimensional construction element shown in FIG. 4 constitutes a dwelling unit for an apartment building, a hospital or hotel etc., and comprises a body of generally polyhedral form which is polygonal in cross section and longitudinal section, this body being smooth and reinforced or decorated on the inside and may be open at one or both ends, and may, of course, also have openings in the sides, notably a door 4, as shown by dotted lines. The sides of The parallelepiped thus formed are generally between 1.5 and 7.0 meters long, i.e. basically corresponding to the dimensions of apartment units.

This element comprises external transverse ribs 10 the neutral grain of which is located in a plane parallel to the planes defining in apertures at the end of the element, this plane preferably being a median plane, whilst the rib forms a static undeformable system with the body of the element. The ribs 10 are intended to interlock between the similar ribs of an adjacent element as shown in FIG. 9, where the ribs 10 of the element interlock between the ribs 10' of the superimposed element B and between the ribs (not shown) of the adjacent element D.

The ribs 10 are rectilinear and form closed transverse frames statically indeterminate. The angles and sides of these frames have bevelled surfaces 11 and 12 respectively to make it easier to assemble several elements.

Figure 5:
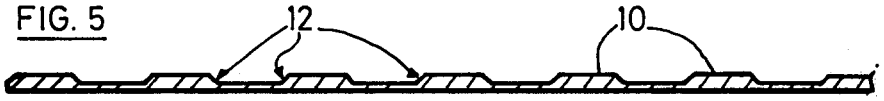
FIG. 5 is a view of a section along the line V—V in FIG. 4.
Figure 6:
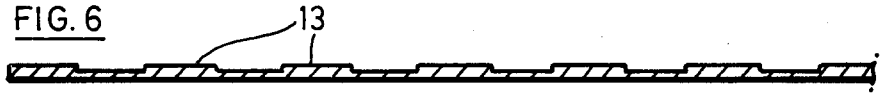
FIGS. 6–8 are sections through three variants, similar to FIG. 5.
Figure 7:
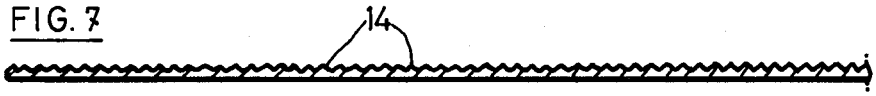
Figure 8:
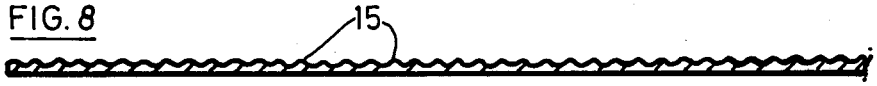

FIG. 5 shows a section through one of the large sides of the element with the ribs 10 and the bevelled surfaces 12. In the variants represented in FIGS. 6–8, the ribs are either rectangular, as shown at 13 in FIG. 6, or in the form of saw teeth 14 (FIG. 7) or undulations 15 (FIG. 8).

The element described may be produced either continuously by the internal tunnel shuttering and external shuttering traditionally used for ribs with intermediate reinforcements, or by lamination, extrusion or any other process suitable for the type of material used. This material may be reinforced concrete, cellular concrete, wood, metal or synthetic board, such as plywood, for example.

In a variant of the process, statically indeterminate frames are used surrounding smooth interior walls reinforced or decorated so as to form a rigid undeformable cell similar to that in FIG. 4.

Moreover, the materials chosen may be covered by a protective layer which thus insulates the element from sound and heat, etc. Instead of beingin the same plane, the ribs could be continued in a spiral arrangement relative to the body of the element without altering the statically indeterminate effect obtained by the angles.

FIG. 9 shows an example of the assembly of four elements A, B, C and D constituting part of a construction. The ribs of these elements interlock reciprocally in one another as shown in the section in FIG. 10 along a plane perpendicular to the common edge of the four elements.

FIG. 11*a* shows a section along a horizontal plane through the adjacent elements A and D and FIG. 11*b* shows a section along a vertical plane through the superimposed elements A and B.

The sides of the parallelepipedal element described comprise means such as, for example, rods or spindles (not shown) to enable wheels to be fitted with a view to transporting this element by road.

FIGS. 12–14 show the ribbed element described above comprising at each end a set of wheels 21, 22 and a lifting device diagrammatically shown at 23 and 24, respectively, serving to lift the element from the position shown with solid lines into the position shown with dotted lines in FIGS. 12 and 13 to enable it to be towed by a road vehicle 25. Thus, the loading and unloading of the element are done automatically. Of course, any kind of connection intended to increase the rigidity of the convoy may be provided between the axles 21 and 22, for example by means of the tie rods working under traction.

FIGS. 15–17 show a particular method of manufacturing the construction element described herein. As shown in FIG. 15, the element is formed by juxtaposing statically indeterminate frames 16 manufactured separately and stuck together or assembled with one another by compression, using the tensile strength of bars 17. These bars could also be placed differently. FIG. 16 shows the finished element with the junction lines indicated at 18 on the outside and at 19 on the inside, the glued surfaces 20 being inclined or in any desired form relative to the interior wall of the element in order to improve adhesion and encourage precision in assembling.

Figure 12A:
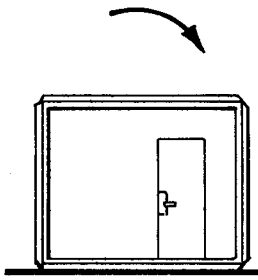
Figure 12B:
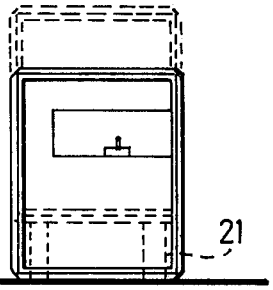

An important advantage of the element described herein is that it enables a static, undeformable system to be made which can be turned over onto its small side without any risk of breakage, as shown in FIGS. 12*a* and 12*b*. The small side of the element turned over in this way determines the width of the vehicle in the convoy, which should not exceed the statutory permissible width of transporting vehicles traveling on the highways. This makes it possible to avoid having the transport subject to special authorization, as is usually the case for elements which are not sufficiently rigid to be turned over onto their small side.

Another advantage of the element described herein is that it can be used to construct apartments without any need to provide a binding material between the vertically and horizontally interlocking or fitting ribs of the juxtaposed or superimposed elements. Moreover, this construction has the advantage of having a high degree of resistance to seismic forces.

FIGS. 18 and 19 show the arrangement of reinforcements in the frames which provide the extra-rigid qualities of the latter. For this purpose, the frame, considered as the non-ribbed parts, comprises a bed of external bars 26 and a bed of internal bars 27 and transverse bars such as 31 and 32.

The internal bars 27 are kept in the ribs, but with a larger cross section (as in $27_1$).

A bed of external bars $26_1$ was provided, but at a greater spacing from the internal bars $27_1$ than they are in the body. Of course, there are also transverse bars of the type shown at 31, the bars of the type shown at 32 being interrupted. In the ribs, as in the slab of the frame, passing from one wall A of the element comprising body and ribs, to the other wall B of the element comprising body and ribs, at right angles to the above-mentioned A the internal bars of the first wall A become the external bars of the second wall B and the external bars of the first wall A become the internal bars of the second wall B.

To strengthen the reinforcement in the corners, on the outside, external bars of the wall A are then used, which will remain on the outside of the other wall B (such as $26_1'$) borrowed from the external bars of the rib in the wall A and following one another on the outside in wall B.

Throughout the construction, yokes (such as 28, 28') and joining or assembly bars (such as 29, 29' and 30, 30') were introduced.

I claim:

1. A three-dimensional construction element comprising a body of generally polyhedral form with an aperture therethrough, characterized in that it comprises at least one peripheral rib forming a closed frame, the sides of said rib and the corners of said element are bevelled, and in that grooves located beside the rib form, separately or together, a geometric figure which is complementary to the figure formed by the rib thereby providing for the engagement of another complementary rib therein.

2. The construction element in accordance with claim 1, wherein said frame having a neutral axis located in a plane parallel to the planes defining the ends of said element having the aperture therethrough and the plane of the neutral axis of the frame formed by the peripheral rib is a median plane of the element.

3. The construction element according to claim 1, comprising several ribs, characterized in that the ribs are separated by grooves the shape and dimension of which are the same as those of the ribs, in such a way that two adjacent elements can be interlocked with one another, being staggered by the width of a rib.

4. A process of mortar-less building utilizing several elements according to claim 1, comprising placing said elements in a juxtaposed or superimposed position in such a way that the ribs of each element engae the grooves of an adjacent element and that the corners of each element engage corners of the adjacent ones.

5. The construction element as claimed in claim 1, forming a parallelepipedal cell, characterized in that the small side of the parallelepiped is between 1.5 and 3.5 meters long and corresponds to the height of the dwelling unit.

6. The construction element as claimed in claim 1, characterized in that it comprises means to enable wheels to be fitted with a view to transporting it by road.

7. The construction element according to claim 1, characterized in that it comprises at each end a set of wheels for transporting it by road and a lifting apparatus, so as to permit the element to be loaded and unloaded automatically.

8. The construction element as claimed in claim 7, characterized in that connecting means are provided between the axles.

9. The construction element as claimed in claim 1, wherein the corners have reinforcement means thereby providing said corners substantially undeformable.

10. The construction element as claimed in claim 1, characterized in that it comprises a protective layer serving to insulate the element from the effects of sound and heat.

11. A process for manufacturing a three-dimensional construction element having a body of generally polyhedral form with an aperture therethrough, at least one peripheral rib forming a closed frame having bevelled corner, and with grooves located beside the rib which separately or together form a geometric figure which is complementary to the rib comprising the steps of, forming a cell of generally polyhedral shape having internal walls which are substantially smooth, and forming at least one peripheral rib on the outer side of said cell so as to obtain a closed frame and forming grooves along the sides of said rib so that they form, separately or together, a geometric figure which is complementary to the figure formed by the rib.

12. The process according to claim 11, further comprising using internal tunnel shuttering and external shuttering in order to cast the body and ribs, respectively, of the element continuously and providing reinforcements between the said shutterings.

13. The process according to claim 11, further comprising forming the element by juxtaposing statically indeterminate frames which are pre-fabricated separately and assembled by pre-stressing them against one another.

14. The process as claimed in claim 11, further comprising using statically indeterminate frames, surrounding the smooth internal walls which are reinforced or decorated so as to form a rigid undeformable cell.

15. A polyhedral shaped construction element open at two opposing ends comrpising: a body composed of four walls each one of which having an internal face and an external face, said external faces each having at least one rib being situated in a common plane parallel to said open ends and forming a continuous peripheral frame having bevelled corners, both sides of said rib being bevelled so that the outline of a rib and the outline of adjacent spaces are complementary and thereby adapted to engage another complementary bevelled rib.

16. The construction element according to claim 15, comprising one frame the median plane of the ribs of which is a median plane of the element.

17. A process of mortar-less building utilizing several elements according to claim 16, comprising placing said elements in a juxtaposed or superimposed position in such a way that the ribs of each element engage the grooves of an adjacent element.

18. A polyhedral-shaped construction element open at two opposing ends, having a body composed of four walls each one of which having an internal face and an external face, said external faces having ribs integrally formed with them, at least four of said ribs being situated in a common plane parallel to said open ends and forming a continuous peripheral frame, said ribs being reinforced internally and at the corners of said frame whereby at least one frame is obtained, said element comprising, at least two of said parallel frames the ribs of which are bevelled and between which peripheral grooves are formed the shaped and dimensions of which are the same as those of the ribs, so that where two of such elements are superimposed or juxtaposed, every rib of one element substantially exactly engages one of said grooves of the other element, characterized in that all sides and corners of the ribs are bevelled, these bevels are adapted so that where at least four of said construction elements are assembled by placing two of them side by side and superimposing thereon similarly juxtaposed elements a perfectly joined structure is formed.

19. The construction element according to claim 18, wherein the small side of the element is between 1.5 and 3.5 meters long and corresponds to the height of a dwelling unit.

20. The construction element according to claim 18, further comprising means to enable wheels to be fitted for transporting it by road with the element turned over to have its small side parallel to the road.

21. A process for manufacturing elements according to claim 18, comprising using internal tunnel shuttering and an external shuttering in order to cast the body and the ribs, respectively, of the elements continuously, and providing reinforcements between said shutterings.

22. A three-dimensional construction element comprising:

a body of generally polyhedral form with an aperture therethrough;

a plurality of peripheral ribs forming a closed frame, said ribs having bevelled sides and the corners of said peripheral ribs are bevelled, said ribs are spaced apart by grooves which are of a geometric figure complementary to the figure of the ribs thereby providing for the engagement of another complementary rib therein.

23. A polyhedral-shaped construction element open at two opposing ends, having a body composed of four walls each one of which having an internal face and an external face, said external faces having ribs integrally formed with them, at least four of said ribs being situated in a common plane parallel to said open ends and forming a continuous peripheral frame, said ribs being reinforced internally and at the corners of said frame, said element comprising several of said parallel frames the ribs of which are bevelled and between which peripheral grooves are formed the shape and dimensions of which are the same as those of the ribs, and the system of said ribs and grooves extending on the whole said external faces, so that where two of such elements are superimposed or juxtaposed, every rib of one element substantially exactly engages one of said grooves of the other element, and in which all sides and corners of the ribs are bevelled, bevels of the corners being such that the plane containing the external surface of each bevelled corner and the plane containing the external surface of a rib adjacent to said corner comprise an angle of 45°.

24. A three-dimensional construction element comprising a hollow body of generally polyhedral form characterized in that it comprises peripheral ribs forming closed frames, and in that grooves located besides the ribs form a geometric figure which is complementary to the figure formed by the ribs, the sides and the corners of said ribs being bevelled in such a manner that where several elements are interlocked with one another, elements located side by side are interlocked by reciprocal engagement of the ribs of one element with the grooves of the adjacent one, while diagonally opposed elements, where two adjacent elements are superimposed to two other adjacent elements, engage one another by their respective bevelled corners.

25. A three-dimensional construction element comprising a hollow body of generally polyhedral form characterized in that it comprises peripheral ribs forming closed frames, and in that grooves located beside the ribs form a geometric figure which is complementary to the figure formed by the ribs, the sides and corners of said ribs being complementary bevelled in such a way that where several elements are interlocked with one another, elements located side by side are interlocked by reciprocal engagement of the ribs of one element with the grooves of the adjacent one, while diagonally opposed elements, where two adjacent elements are superimposed to the other adjacent elements, engage with one another by their respective bevelled corners, and that the plane containing the external surface of each bevelled corner and the plane containing the external surface of a rib adjacent to said corner comprise externally an angle of 45°.

26. A three-dimensional construction element comprising a hollow body of generally polyhedral form characterized in that it comprises peripheral ribs forming closed frames, and in that grooves located beside the ribs form a geometric figure which is complementary to the figure formed by the ribs, the sides and the corners of said ribs being bevelled in such a manner that where several elements are interlocked with one another, elements located side by side are interlocked by reciprocal engagement of the ribs of one element with the grooves of the adjacent one, while diagonally opposed elements, where two adjacent elements are superimposed to two other adjacent elements, engage one another by their respective bevelled corners, with substantially no voids between any two adjacent of said several elements.

27. A three-dimensional construction element comprising a hollow body of generally polyhedral form characterized in that it comprises peripheral ribs forming closed frames, and in that grooves located beside the ribs form a geometric figure which is complementary to the figure formed by the ribs, the sides and corners of said ribs being complementary bevelled in such a way that where several elements are interlocked with one another, elements located side by side are interlocked by reciprocal engagement of the ribs of one element with the grooves of the adjacent one, while diagonally opposed elements, where two adjacent elements are superimposed to the two other adjacent elements, engage with one another by their respective bevelled corners, no void at all remaining between any two adjacent of said several elements, and that the plane containing the external surface of each bevelled corner and the plane containing the external surface of a rib adjacent to said corner comprise externally an angle of 45°.

* * * * *